US006915946B2

(12) United States Patent
Gosis et al.

(10) Patent No.: US 6,915,946 B2
(45) Date of Patent: Jul. 12, 2005

(54) PACKAGING CONTAINER WITH INTEGRAL RIGIDIZER

(75) Inventors: Anatoly Gosis, Palatine, IL (US); Michael D Loeschen, Hawthorn Woods, IL (US); Ian Brooks, Lake Barrington, IL (US); G. Michael Velan, Mt. Prospect, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 19 days.

(21) Appl. No.: 10/289,952

(22) Filed: Nov. 7, 2002

(65) Prior Publication Data

US 2004/0089703 A1 May 13, 2004

(51) Int. Cl.[7] ..... B65D 5/32; B65D 5/355

(52) U.S. Cl. ..... 229/101; 206/443; 220/4.21; 220/691; 220/794; 220/DIG. 25; 229/122.32; 229/125.19

(58) Field of Search ..... 229/5.5, 101, 122.32, 229/125.19; 220/4.21, 4.24, 621, 691, 780, 794, 796, 4.01, DIG. 25; 206/443, 446

(56) References Cited

U.S. PATENT DOCUMENTS

| | | | | | |
|---|---|---|---|---|---|
| 1,035,634 | A | * | 8/1912 | Platt | 220/794 |
| 1,069,021 | A | | 7/1913 | Miller | |
| 1,352,863 | A | * | 9/1920 | Zeitler et al. | 224/221 |
| 1,758,230 | A | | 5/1930 | Lange | |
| 1,791,003 | A | * | 2/1931 | Shearer | 229/125.19 |
| 1,871,888 | A | | 8/1932 | Johnson | |
| 1,976,209 | A | * | 10/1934 | Ashe | 220/691 |
| 2,122,904 | A | * | 7/1938 | Ambrosius | 220/621 |
| 2,194,669 | A | | 3/1940 | Mumford | |
| 2,317,884 | A | | 4/1943 | Clouston | |
| 2,418,248 | A | * | 4/1947 | Denton | 229/125.19 |
| 2,718,980 | A | * | 9/1955 | Strom | 220/780 |
| 2,731,167 | A | | 1/1956 | Moore | |
| 3,543,994 | A | | 12/1970 | Clark | |
| 3,552,633 | A | | 1/1971 | Ketler | |
| 3,669,338 | A | | 6/1972 | Cornell et al. | |
| 3,833,116 | A | | 9/1974 | Howe | |
| 3,938,691 | A | * | 2/1976 | Dumas | 220/780 |
| 4,607,750 | A | | 8/1986 | Valenti | |
| 4,629,069 | A | | 12/1986 | Pugh | |
| 4,662,512 | A | | 5/1987 | Durand | |
| 4,871,067 | A | | 10/1989 | Valenti | |
| 4,976,374 | A | | 12/1990 | Macaluso | |
| 5,141,149 | A | | 8/1992 | Fulton | |
| 5,310,070 | A | * | 5/1994 | Haas et al. | 220/4.24 |
| 5,657,872 | A | | 8/1997 | Leftwich et al. | |
| 6,027,017 | A | | 2/2000 | Kuhn et al. | |
| 6,382,447 | B1 | | 5/2002 | Loeschen | |
| 6,499,655 | B1 | | 12/2002 | Moen | |

* cited by examiner

*Primary Examiner*—Gary E. Elkins
(74) *Attorney, Agent, or Firm*—Mark W. Croll, Esq.; Donald J. Breh, Esq.; Welsh & Katz, Ltd.

(57) ABSTRACT

A packaging container is formed form a preformed, rigid first unit of U-shaped cross-section having a generally flat base wall and opposing side walls and a preformed, rigid second unit of U-shaped cross-section having a generally flat base wall and opposing side walls. The second unit is configured so that the side walls of the first unit are fitted within and embraced by the side walls of the second unit when the first unit and second unit are assembled as a container. The opposing side walls of the first and second units each having an embossing formed therein, such that the embossing of each side wall of the first unit engages the embossing of a corresponding, mated side wall of the second unit. The engaged embossings secure the first and second units to one another. The package can include integrally formed end closures.

4 Claims, 3 Drawing Sheets

PACKAGING CONTAINER WITH INTEGRAL RIGIDIZER

BACKGROUND OF THE INVENTION

The present invention is directed to a packaging container. More particularly, the present invention pertains to a packaging container having integral rigidizing elements or formations.

Packaging for lengthy and odd shaped items takes many forms. One construction includes a pair of corrugated, laminated paperboard top and bottom U-shaped channels configured for one to fit within the other. Most packages formed in this manner require separate end closures or caps, usually manufactured from cardboard or wood, and require some manner of sealing the package. End caps generally are stapled to adjacent package walls. Not only does this method necessitate close-fit manufacturing, but it is also very cumbersome at installation, and may cause content damage due to incompletely formed or off-positioned staples. Moreover, sealing the container, as by adhesive or banding adds both time and cost to the packaging operation.

In another variety of packaging container, one of the top and bottom U-shaped channels has a notch cut into opposing side walls of the "U," so that the "U" portion may be folded over at a 90 degree angle. In such a configuration, channel ends are closed by the folded base portion and the side walls of the "U," which are folded over adjacent side walls. Nevertheless, to seal such a package, tape or a like strip-type adhesive sealant must be extended over the flaps that then are folded over the adjacent side walls. Even though a seal may be formed, however, openings may remain at the juncture of the folded-over base portion and the cover portion, seriously weakening the package. This design is disclosed in U.S. Pat. No. 4,976,374, which is incorporated herein by reference.

Another existing packaging container, disclosed in U.S. Pat. No. 6,382,447, resolves the above-referenced problems by providing a packaging container in which the entirety of the end closure is formed from the packaging material itself. However, the container base unit, which forms end closures for the packaging container, features mitered corners. These mitered corners require complex die-cutting with mirror-image tools, and mandatory strapping at specific positions to restrain the mitered flaps.

The use of such packaging containers, while widespread, can still be quite costly. This is particularly so with odd-shaped items or items that require non-standard packages. Moreover, all of these packages require some method or device to close or seal the package. That is, a band or adhesive or the like must be used to close the package top onto the package bottom. In addition, these known packages do not permit securely containing odd shaped items which can shift or move around after packaging and sealing.

Accordingly, there exists a need for a packaging container that can close and seal onto itself. Desirably, such a container can be closed without the need for bands, adhesive or the like. More desirably, a packaging container can be used for packaging odd-shaped items or items that cannot otherwise be efficiently packaged in standard sized or standard shape packaging. Most desirably, all of these packages include built-in or integral rigidizing elements to provide rigidity and enhanced structural integrity to the package.

BRIEF SUMMARY OF THE INVENTION

An embodiment of a packaging container is formed from preformed, rigid first and second units of U-shaped cross-section, Each of the units has a generally flat base wall and opposing side walls. The second unit is configured so that the side walls of the first unit are fitted within and embraced by the side walls of the second unit when the first unit and second unit are assembled as a container.

The opposing side walls of the first and second units each have an embossing formed therein. The embossing of each side wall of the first unit engages the embossing of a corresponding, mated side wall of the second unit. The engaged embossings secure the first and second units to one another.

For purposes of the present disclosure, some of the packaging material, although referred to as having a U-shaped cross-section is, in fact, formed from a material having a channel-like or squared U-shape having a flat or near-flat bottom wall. The corners can be formed having a radius of curvature (e.g., rounded) or they may be formed having relatively sharp angles. However, again, for purposes of the present disclosure, the container material is referred to as "U-shaped".

In a present embodiment, the embossings extend fully longitudinally along each of the side walls. The embossings can have a variety of shapes, such as a V-shape. In one packaging container, the embossings in the side walls of the first unit are formed at a height equal to one another and wherein the embossings formed in the side walls of the second unit are formed at a height equal to one another. This facilitates ready assembly of the container regardless of the orientation of the units.

Alternately, the packaging container can be formed such that each of the side walls of the first unit include a plurality of embossings therein (i.e., at different heights relative to the base or bottom wall) and the embossing in the side walls of the second unit are engageable with any of the embossings in the first unit corresponding side wall.

An alternate embodiment of the packaging container includes a preformed, rigid first unit having at least first and second panels formed at an angle relative to each other. At least one of the panels has a plurality of corrugations formed therein. The corrugations are formed longitudinally along the panel.

A preformed, rigid second unit has at least first and second panels formed at an angle relative to each other. The second unit is configured for engagement with the first unit to form at least a portion of the packaging container.

In this alternate embodiment, the first unit can be formed having a U-shaped cross-section having a generally flat base wall and upstanding side walls. The plurality of corrugations is formed in the generally flat base wall. The second unit can likewise be formed having a U-shaped cross-section having a generally flat base wall and upstanding side walls.

Alternately still, the packaging container first unit can be formed as separate first and second panels with the corrugations formed on the first panel. In such an arrangement, the packaging container includes a preformed, rigid third unit having first and second panels and having a plurality of corrugations formed on the first panel. The corrugations of the first unit first panel engage the corrugations of the third unit first panel to form a bottom portion of the packaging container. That is, when the respective first and third panel corrugations are engaged with one another they define a generally U-shaped cross-section bottom unit.

In still another embodiment of the packaging container, the first and second units each have first and second panels and the first and second panels of the first and second units each include a plurality of corrugations. A preformed, rigid third unit has first and second panels formed at an angle relative to each other. The first and second panels of the third unit have a plurality of corrugations formed therein formed longitudinally along the panel. The corrugations of each panel are engaged with the corrugations of each adjacent panel to form the packaging container. In such a configuration, a fourth panel can be added with the corrugations of each panel engaging the corrugations of adjacent panels to form the packaging container. It is further anticipated that end closures can be formed integral with packages.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
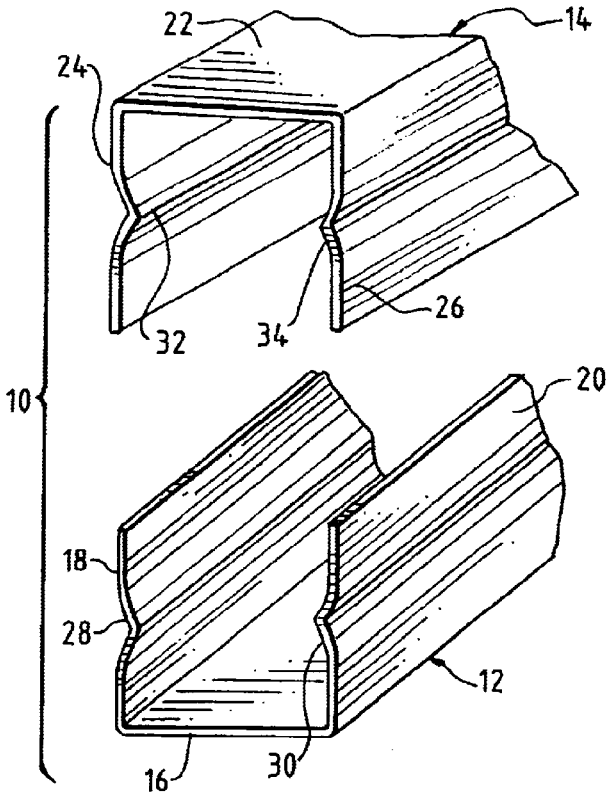
FIG. 1 is a perspective view of the base and cover units of one embodiment of a packaging container with integral rigidizer embodying the principles of the present invention, the container being illustrated unconstructed, with the cover removed from the base.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Referring now to the figures and in particular FIG. 1, there is shown one embodiment of a packaging container 10 with integral rigidizer embodying the principles of the present invention.

The packaging container 10 includes a base unit 12 and a cover unit 14. Both the base unit 12 and the cover unit 14 are formed having a generally U-shaped cross-section. Preferably, the base unit 12 and the cover unit 14 are formed from laminated paperboard material. Other materials can, however, be used to form the base and cover units 12, 14.

The base unit 12 includes a generally flat bottom wall 16 and upstanding side walls 18, 20. The cover unit 14 includes a generally flat top wall 22 and upstanding (or as seen, depending) side walls 24, 26. Again, those skilled in the art will appreciate that although the container 10 is referred to as "U-shaped", the package 10 is actually formed from a channel-like structure having flat or near-flat bottom and top walls 16, 22.

It will also be appreciated by those skilled in the art that the material from which the base and cover units 12, 14 is formed is a rigid material. As such, once the material is formed in the flat bottom 16 (or top 22) U-shape (or near flat bottom 16 or top 22 U-shape), the walls 18,20 and 24, 26 of the units 12, 14 will tend to return to the position at which the units were formed. In this manner, if the walls 18, 20 and 24, 26 are formed perpendicular to the bottom or top wall 16 or 22, when the walls 18, 20 or 24, 26 are urged outward or inward, they will return or tend to the perpendicular state.

Figure 2:
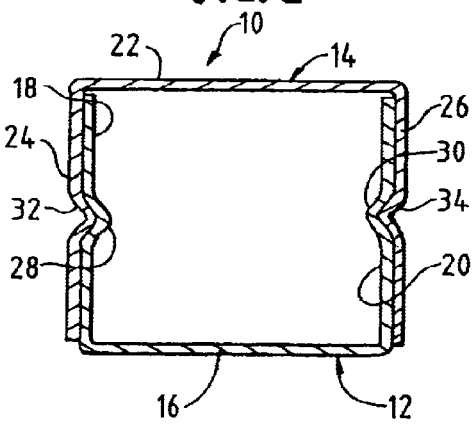
FIG. 2 is a cross-sectional view of the container of FIG. 1, with the cover positioned on the base unit.
Figure 3:
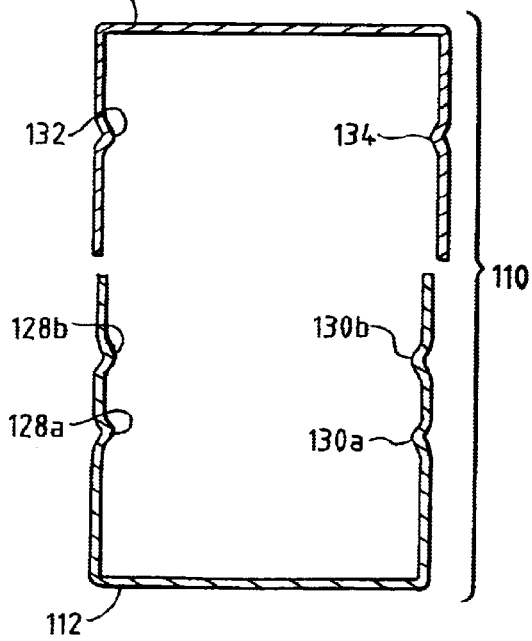
FIG. 3 is a cross-sectional view of an alternate embodiment of the packaging container illustrated in an unconstructed form.

The rigidizer in this embodiment is formed as longitudinally formed embossings 28, 30, 32, 34 in the side walls 18, 20, 24, 26, respectively. The embossings 28–34 can be formed as a single embossing in each side wall as illustrated in FIGS. 1 and 2. Alternate, as will be discussed below and as illustrated in FIG. 3, a plurality of embossings or corrugations can be formed in each of the side walls.

Referring again to FIG. 1, the single embossing 28-34 is formed in each of the side walls 18, 20 and 24, 26, and can be formed coextensively with the side walls 18, 20 and 24, 26. That is, the embossings 28-34 can extend fully along the length of each side wall 18, 20 and 24, 26.

The embossing 28–34 can be formed having a relatively simple "V-shaped" configuration. Other embossing configurations can be formed, such as square or rectangular embossings, semi-circular embossings and the like. All such other embossing configurations are within the scope and spirit of the present invention.

In a present package 10, the embossings 28–34 are formed in a mirror image on each of the base side walls 18, 20 and cover side walls 24, 26. That is, the embossing 28 on base unit side wall 18 is at the same location or position as the embossing 30 on the other side wall 20. The same is true of the cover unit side wall 24, 26 embossings 32, 34. In this manner, the cover or base unit 12 or 14 can be rotated and the package units 12, 14 still fit with one another. To join the package units 12, 14, that is to assemble the package 10, it is only necessary to position the cover 14 on the base 12 and urge the cover 14 downward. The cover wall embossings 32, 34 engage the base wall embossings 28, 30 to secure the cover 14 on the base 12.

As set forth above, because the walls 18, 20 of the base 12 and the walls 24, 26 of the cover 14 tend to return to their "as formed" shape, the cover unit walls 24, 26 will tend to apply an inward force on the base units walls 18, 20 and the base unit walls 18, 20 will tend to apply an outward force on the cover unit walls 24, 26 when the package 10 is assembled. The opposite forces will tend to maintain the embossings 28, 32 and 30, 34 interlocked or engaged with one another to retain the cover 14 on the base 12.

Those skilled in the art will recognize that a wide variety of embossing 28–34 configurations can be used to provide a flexible packaging system 10. For example, as illustrated in FIG. 3, the base unit 112 can be formed with a plurality of embossings 128*a,b* and 130*a,b* at different heights so that the cover 114 can be fitted onto the base 112 unit to provide different internal height packages 110. In this manner, one packaging 110 configuration can be used for items having different package height requirements. All such embossing configurations (e.g., quantities and positions) are within the scope and spirit of the present invention.

Figure 4:
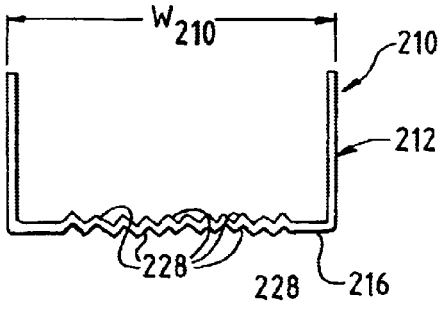
FIG. 4 is a cross-sectional view of an alternate embodiment of a container base embodying the principles of the present invention.

An alternate embodiment of the packaging container 210 is illustrated in FIG. 4. In this embodiment 210, the base unit 212 is formed as a panel 216 having a plurality of embossings 228 formed along at least a portion of the surface thereof. As seen in FIG. 4, the base unit 212 bottom wall or panel 216 has a plurality of embossings 228 (formed as ridges or corrugations). The ridges 228 serve as stiffeners, providing a more stable package during, for example, bending deformations of the package 210. It has also been found that the ridges 228 permit use of different cover units (not shown) that may differ from an "ideal" mating cover size. Such a base unit 212 has been found to be especially suitable for use in forming relatively wide packaging containers. The ridges 228 also permit slight expansion and contraction of the base 212 along the width $W_{210}$ of the base 212.

Figure 5:
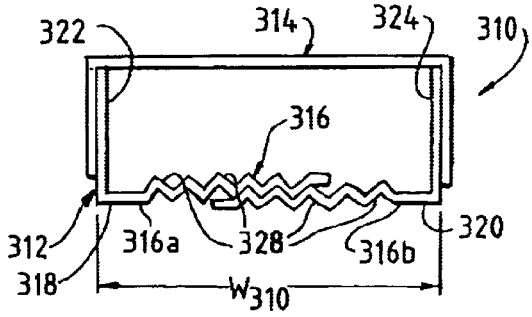
FIG. 5 is a cross-sectional view of still another alternate embodiment of the container constructed from a plurality of mated panels forming the bottom or base of the container.

Referring now to FIG. 5, there is shown a container 310 in which the base unit 312 is formed from two panels 318, 320 each having a generally L-shaped profile. Each panel 318, 320 forms a side wall 322, 324 of the package 310 and a portion 316*a,b* of the package bottom wall 316. The portions 316*a,b* of the panels 318, 320 that form the bottom wall 316 have a plurality of the ridges 328 formed therein. The ridges 328 are formed longitudinally along each side of the panels 318, 320.

In such a packaging 310 configuration, not only do the ridges 328 provide strength and structural integrity to the package 310, but also provide for expandability of package 310 in the width $W_{310}$ direction. That is, the panels 318, 320 can be engaged with one another at any of the ridges 328 to form a package 310 of a desired width $W_{310}$ to suit a specific item's requirements. An appropriate cover 314 size can then be positioned on the panels 318, 320 to complete the packaging container 310.

Figure 6:
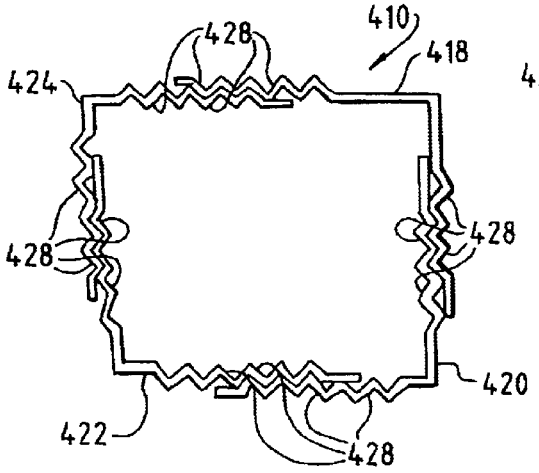
FIG. 6 is a cross-sectional view of yet another alternate embodiment of the container constructed from a plurality of panels.
Figure 7:
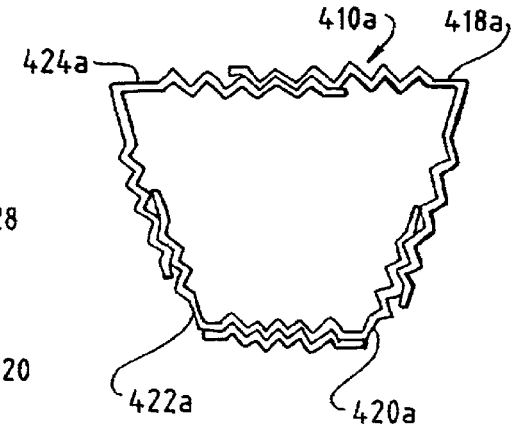
FIG. 7 is a cross-sectional view of still another alternate embodiment of the container, similar to that of FIG. 6 and also constructed from a plurality of panels.

As seen in FIGS. 6 and 7, L-shaped panels 418, 420, 422, 424 provide extreme flexibility to meet specific packaging needs. In this packaging container 410, the four the L-shaped panels 418–424 are engaged with each adjacent panel to form a versatile and flexible package 410. The relative positioning of each panel 418–420 can be varied (relative to its adjacent panels) to vary the height $H_{410}$ and width $W_{410}$ of the package 410 by interlocking or engaging the panels 418–424 with adjacent panels at different ridge 428 locations. Moreover, such a package 410 can be used to form a container 410 that has an other than rectangular cross-section, as exemplified by the container 410*a* in FIG. 7. The ridges 428 are engaged with the ridges of the adjacent panels to further assure that the desired configuration and size are maintained during, for example, packing, shipping and storage. As will be appreciated by those skilled in the art, same-size panels 418–424 need not be used to form the package 410. Rather, as shown in FIG. 7, the panels 418*a*–424*a* can be of different sizes so that a most desired configuration (e.g., cross-section) and size can be achieved.

Figure 8:
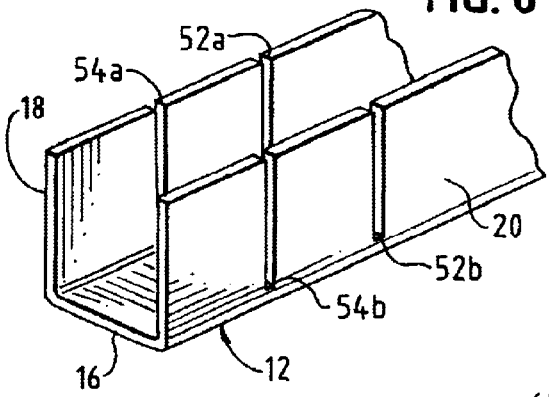
FIG. 8 is a perspective view of a package end configuration the permits the formation of integral end closures.
Figure 9:
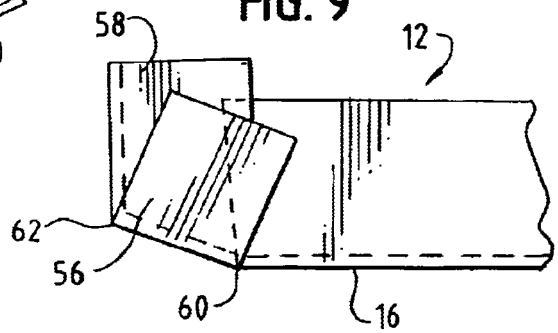
FIG. 9 is a side view illustrating the folding in-progress of the end closure.
Figure 10:
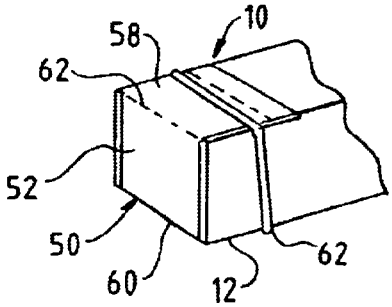
FIG. 10 is a perspective view of the end closure shown with a band positioned around the closure to seal the package.

Referring now to FIGS. 8–12, the present packaging container 10-310 can be configured with integral end caps or end closures, such as that indicated at 50 in FIG. 10. As seen in FIG. 10, the end closure 50 is formed from a portion of the packaging container 10, for example, the base 12 of the container 10.

Referring to FIG. 8, the exemplary base 12 is cut, transversely, through the side walls 18, 20. The cuts 52*a,b* and 54*a,b* extend to, but not through, the base wall 16. These cuts 52, 54 define a first closure panel 56 extending from and adjacent to an end of the base unit 12, and a second closure panel 58 extending from and adjacent to an end of the first closure panel 56. The base unit 12 and the first closure panel 56 are separated from one another by a first fold line 60 (FIG. 9). The first closure panel 56 and the second closure panel 58 are separated from one another by a second fold line 62. The fold lines 60, 62 are preferably formed by embossing the base wall 16 to compress the material along the lines 60, 62.

As illustrated in FIGS. 9 and 10, the first closure panel 56 is configured for folding generally perpendicular to the base unit bottom wall 16, and the second closure panel 58 is configured for folding generally perpendicular to the first closure panel 56 and generally parallel to the base unit bottom wall 16.

In a preferred embodiment, the base unit side walls 18, 20 are about equal in height to the first and second closure panel 56, 58 side walls. As illustrated, the first and second closure panel 56, 58 side walls are configured for insertion inside the base unit side walls 18, 20 when the end closure 50 is formed. The base unit 12 can include two end closures, each positioned at an end of the base unit. A band 64 can be fitted around the closure 50 to seal the packaging container 10. Alternately, an adhesive (not shown) can be used to seal the packaging container 10.

Figure 11:
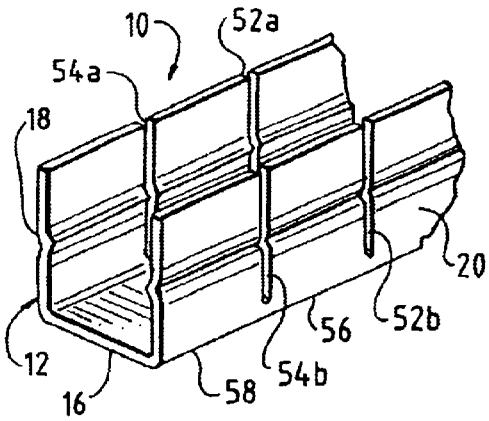
FIG. 11 is a perspective view of the base unit of the packaging container of FIGS. 1 and 2 shown with the transverse cuts for forming the end closure.
Figure 12:
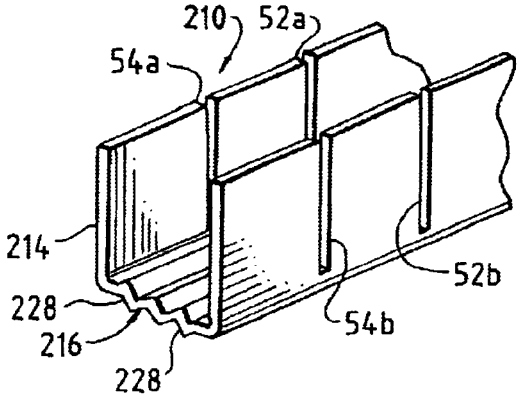
FIG. 12 is a perspective view of the base unit of the packaging container of FIG. 4 shown with the transverse cuts for forming the end closure.

As seen in FIGS. 11 and 12, the integral end closures can be formed with the package embodiments of FIGS. 1–3 and 4, by forming the side wall cuts 52*a,b* and 54*a,b* and by embossing the base wall 16, 216. It is anticipated that if a corrugated panel is used with a non-corrugated panels (for example, if the base unit 212 of FIG. 4 is used with a non-corrugated top 314 as seen in FIG. 5), the end closure will be formed using the non-corrugated unit 314. However, it is also anticipated that the corrugated unit 212 can be used to form the closure (as seen in FIG. 12) by embossing the panel 216 over the corrugations 228.

It is also anticipated that the integral closures can be formed using the L-shaped panels illustrated in FIGS. 5 and 6. In this configuration, a cut is formed in one of the side walls (the one that serves as a side wall) and the other (or base wall portion) has the embossing or fold line formed therein. It will be appreciated by those skilled in the art that the opposing side walls will both require cuts while the abutting base walls will require embossing.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A packaging container, comprising:

a preformed, rigid first unit of U-shaped cross-section having a generally flat base wall and opposing side walls; and a preformed, rigid second unit of U-shaped cross-section having a generally flat base wall and opposing side walls, the second unit configured so that the side walls of the first unit are fitted within and embraced by the side walls of the second unit when the first unit and second unit are assembled as a container, the opposing side walls of the first unit having a plurality of embossings therein at different heights and the opposing side wall of the second unit each configured having an embossing formed therein, such that the embossing of each side wall of the first unit engages the embossing of a corresponding, mated side wall of the second unit, such that the engaged embossings secure the first and second units to one another, wherein each of the embossings on the opposing side walls of the first and second units extend fully longitudinally along the length of each of the aide walls, and wherein the embossing in each side wall of the second unit is engageable with any of the plurality of embossings in the corresponding, mated side wall of the first unit.

2. The packaging container in accordance with claim 1 wherein the embossing have a V-shape.

3. The packaging container in accordance with claim 1 wherein the embossings in the side walls of the first unit are formed at a height equal to one another and wherein the embossings formed in the side walls of the second unit are formed at a height equal to one another.

4. The packaging container in accordance with claim 1 including at least one integrally formed end closure.

* * * * *

UNITED STATES PATENT AND TRADEMARK OFFICE

CERTIFICATE OF CORRECTION

PATENT NO. : 6,915,946 B2
DATED : July 12, 2005
INVENTOR(S) : Gosis et al.

It is certified that error appears in the above-identified patent and that said Letters Patent is hereby corrected as shown below:

Column 8,
Line 8, should read -- ...extend fully longitudinally along the length of each of the side walls… --.

Signed and Sealed this

Thirtieth Day of August, 2005

JON W. DUDAS
*Director of the United States Patent and Trademark Office*